US011404761B2

(12) United States Patent
Milojevic et al.

(10) Patent No.: US 11,404,761 B2
(45) Date of Patent: Aug. 2, 2022

(54) METHOD FOR DEPOSITING AN ELECTRICALLY CONDUCTIVE METAL ONTO AT LEAST ONE PORTION OF THE INNER SURFACE OF AN INTERNAL CAVITY OF A WAVEGUIDE

(71) Applicants: AML FINANCES, Fèves (FR); UNIVERSITE DE LORRAINE, Nancy (FR)

(72) Inventors: Jean-Yves Milojevic, Cuvry (FR); Régis Limbach, Courcelles Chaussy (FR); Léo Portebois, Mirecourt (FR); Nicolas Ramenatte, Luneville (FR); Thierry Mazet, Nancy (FR)

(73) Assignees: AML FINANCES, Fèves (FR); UNIVERSITE DE LORRAINE, Nancy (FR)

( * ) Notice: Subject to any disclaimer, the term of this patent is extended or adjusted under 35 U.S.C. 154(b) by 50 days.

(21) Appl. No.: 16/944,657

(22) Filed: Jul. 31, 2020

(65) Prior Publication Data

US 2021/0036397 A1 Feb. 4, 2021

(30) Foreign Application Priority Data

Aug. 2, 2019 (FR) ..... 1908910

(51) Int. Cl.
*H01P 11/00* (2006.01)
*C23C 18/02* (2006.01)
(Continued)

(52) U.S. Cl.
CPC ..... *H01P 11/002* (2013.01); *B05D 3/0254* (2013.01); *B05D 5/12* (2013.01);
(Continued)

(58) Field of Classification Search
CPC ..... B05D 7/22; B05D 7/222; B05D 7/225; B05D 7/24; B05D 7/146; B05D 3/007;
(Continued)

(56) References Cited

U.S. PATENT DOCUMENTS 4,930,863 A 6/1990 Croitoriu et al.
5,398,010 A * 3/1995 Klebe ..... H01P 11/002 156/150

(Continued)

FOREIGN PATENT DOCUMENTS

CA 2197909 A1 * 9/1998 ..... H01P 11/002
EP 0344478 A2 12/1989

(Continued)

OTHER PUBLICATIONS

"Secondary Vacuum Pumps" retrieved from https://www.lubcon.com/en/applications/vacuum-and-nuclear-industry/secondary-vacuum-pumps/ on Dec. 15, 2021. (Year: 2018).*

(Continued)

*Primary Examiner* — William P Fletcher, III
(74) *Attorney, Agent, or Firm* — Seckel IP, PLLC

(57) ABSTRACT

A method for depositing an electrically conductive metal onto at least one portion of the inner surface (3) of an internal cavity (2) of a waveguide (1) includes: preparing a suspension containing at least one liquid and at least one precursor of the electrically conductive metal in suspension in said at least one liquid; coating at least one portion of the inner surface (3) of the internal cavity (2) of the waveguide (1) with the suspension, and heat-treating at least said portion of the inner surface (3) of the internal cavity (2) of the waveguide (1) coated with the suspension. A method for manufacturing a metallized waveguide can implement this deposition method.

20 Claims, 4 Drawing Sheets

(51) Int. Cl.

| | |
|---|---|
| ***B05D 7/22*** | (2006.01) |
| ***B05D 5/12*** | (2006.01) |
| ***B05D 3/02*** | (2006.01) |
| ***C23C 26/00*** | (2006.01) |
| ***H01P 3/12*** | (2006.01) |
| ***C23C 24/08*** | (2006.01) |

(52) U.S. Cl.
CPC ..... *B05D 7/22* (2013.01); *B05D 7/222* (2013.01); *C23C 18/02* (2013.01); *C23C 24/08* (2013.01); *C23C 26/00* (2013.01); *H01P 3/12* (2013.01); *B05D 2202/35* (2013.01); *B05D 2254/04* (2013.01)

(58) Field of Classification Search
CPC .... B05D 3/0254; B05D 5/12; B05D 2202/35; B05D 2254/04; B05D 2401/10; B05D 2401/20; B05D 2401/21; H01P 11/002; H01P 3/12; C23C 18/02; C23C 24/08; C23C 26/00
See application file for complete search history.

(56) References Cited

U.S. PATENT DOCUMENTS

| | | | |
|---|---|---|---|
| 5,656,181 | A | 8/1997 | Biasse et al. |
| 2005/0265677 | A1 | 12/2005 | Hongo et al. |
| 2006/0222762 | A1 | 10/2006 | McEvoy et al. |
| 2015/0306664 | A1 | 10/2015 | Aklint et al. |

FOREIGN PATENT DOCUMENTS

| | | | |
|---|---|---|---|
| EP | 0691554 | A1 | 1/1996 |
| WO | 2013030064 | A1 | 3/2013 |

OTHER PUBLICATIONS

French Search Report and Written Opinion dated Feb. 10, 2020 in priority application No. FR1908910; w/ English machine translation (total 13 pages).

* cited by examiner

METHOD FOR DEPOSITING AN ELECTRICALLY CONDUCTIVE METAL ONTO AT LEAST ONE PORTION OF THE INNER SURFACE OF AN INTERNAL CAVITY OF A WAVEGUIDE

BACKGROUND OF THE INVENTION

(1) Field of the Invention

The present invention relates to a method for depositing an electrically conductive metal onto at least one portion of the inner surface of an internal cavity of a waveguide.

The present invention is related to the field of the manufacture of the waveguides. Without being in any way limited thereto, this invention will find a particularly suitable application when manufacturing a waveguide, which has an internal cavity with a small diameter and/or a complex shape, namely a winding shape.

(2) Description of the Prior Art

Already known are waveguides, which are intended to transmit electromagnetic signals, and which find, more particularly, an application in the field of aeronautics or aerospace, namely in the framework of the construction of radars.

Such waveguides can be made of a metallic material or of a polymeric material. These waveguides can have various shapes, namely complex shapes, for example winding shapes with a plurality of bends. In addition, these waveguides have an internal cavity, the cross-section of which can adopt different shapes (rectangular, square, circular, elliptical shapes or the like) and different dimensions (which can range from a few tenths of a millimeter to several centimeters).

In order to be able to transmit electromagnetic signals in an appropriate way, the internal cavity of these waveguides must have an inner surface, the electrical conductivity properties of which are very high and the condition of which is not very uneven. In particular, this inner surface must have a low roughness.

Known, in particular, are waveguides made of a titanium alloy. These waveguides have an internal cavity, the inner surface of which has electrical conductivity properties, which prove to be insufficient for some applications. In order to cope with this drawback, it has been devised to deposit an electrically conductive metal onto this inner surface.

The deposition onto this inner surface of such an electrically conductive metal can be performed according to a first method, which consists in depositing silver electrolytically.

This first method consists, first of all, in stripping the inner surface and then in depositing onto the stripped inner surface a nickel coating by means of a chemical process. Afterwards, an anode is positioned inside the waveguide and this waveguide is connected to a cathode. Then, a series of quenches of this waveguide is carried out in several successive silver-containing baths. During these successive quenches, an electric current is caused to pass between the anode and the cathode, through the silver-containing bath. This results into a deposition of silver onto the inner surface of the waveguide by electrolysis.

This first method has, however, a number of drawbacks. In particular, this first method permits to deposit onto the inner surface of the internal cavity of a waveguide a layer of silver, which has only a small thickness (from a few microns to 15 microns). In addition, this first method does not permit to deposit a constant thickness of silver onto the entire inner surface of the internal cavity. Besides, at each break in shape, edge effects appear. Finally and as mentioned above, this first method consists in positioning an anode inside the internal cavity of the waveguide, which greatly limits the size of the internal cavity and the complexity of the shape of the waveguides likely to be treated by this first process, while the current trend is to go towards waveguides, the cross-section of which is increasingly smaller and the shapes of which are increasingly complex.

A solution for some of these drawbacks has been provided by a second method, which consists in depositing silver chemically.

This second method has similarities with the first method described above, but differs from this first method in that the deposition of silver is carried out without any intervention of electric current.

Although this second method permits to deposit silver onto the inner surface of an internal cavity of a waveguide, which has a complex shape and/or an internal cavity with a small cross-section, this second method has, however, other drawbacks.

In this respect, it should be observed that the implementation of this second method proves particularly long, which limits its use on an industrial scale. In addition, the results obtained by the implementation of this second method have not yet permitted to obtain the qualification of this method for the manufacture of the waveguides in some specific fields, namely in the field of aerospace.

In addition, for the implementation of this second method, it is necessary to use compounds, which provide the baths with auto-catalytic properties, such as phosphorus. These compounds lead to the formation of fragile intermetallic phases when the waveguide is subjected to a rise in temperature.

SUMMARY OF THE INVENTION

The present invention pretends to cope with the drawbacks of the state-of-the-art packaging devices.

To this end, the invention relates to a method for depositing an electrically conductive metal onto at least one portion of the inner surface of an internal cavity of a waveguide. This method consists in that:

- a suspension, which contains at least one liquid and at least one precursor of the electrically conductive metal in suspension in said at least one liquid, is prepared;
- at least one portion of the inner surface of the internal cavity of the waveguide is coated with the suspension;
- at least said portion of the inner surface of the internal cavity of the waveguide coated with the suspension is heat-treated.

Another feature is related to the fact that said at least one liquid at least partially consists of at least one solvent (namely which at least partially consists of alcohol) and/or of at least one binder (namely which at least partially consists of water).

Another feature is related to the fact that said at least one precursor of the electrically conductive metal at least partially consists of at least one powder, which is fusible, and which at least partially consists of at least one alloy of the electrically conductive metal and another metal.

Yet another feature is related to the fact that said electrically conductive metal at least partially consists of silver and/or that said waveguide at least partially consists of a titanium alloy.

Another feature is related to the fact that, when at least said portion of the inner surface of the internal cavity of the waveguide coated with the suspension is heat-treated, at least this portion of the inner surface is heat-treated in an inert atmosphere or in a reducing atmosphere and/or at least this portion of the inner surface is heat-treated under vacuum, namely under secondary vacuum.

The invention also relates to a method for manufacturing a metallized waveguide including, on the one hand, a waveguide, which includes an internal cavity having an inner surface and, on the other hand, a layer of an electrically conductive metal deposited on at least one portion of this inner surface. This method is characterized in that the layer of electrically conductive metal is deposited on said at least one portion of the inner surface of the internal cavity of the waveguide by implementing the method described above.

The invention then also relates to a metallized waveguide including, on the one hand, a waveguide, which includes an internal cavity having an inner surface and, on the other hand, a layer of an electrically conductive metal deposited on at least one portion of this inner surface. This waveguide is characterized in that it is obtained by the implementation of the method described above and that it is free of metallurgical defects or fragile areas, at the level of the inner surface of the internal cavity of the waveguide.

Thus, the deposition method according to the invention consists, in particular, in that, on the one hand, a suspension is prepared, which contains at least one liquid and at least one precursor of the electrically conductive metal in suspension in said at least one liquid, on the other hand, at least one portion of the inner surface of the internal cavity of the waveguide is coated with the suspension and, yet on the other hand, at least said portion of the inner surface of the internal cavity of the waveguide coated with the suspension is heat-treated.

This deposition method advantageously and appropriately permits the suspension to penetrate into the internal cavity of a waveguide and to cover the inner surface of such an internal cavity, irrespective of the shape (even complex and/or winding shape) of this waveguide and the cross-section (even very small cross-section, in particular less than one millimeter) of this internal cavity.

This deposition method also advantageously permits to avoid, as in the prior art, introducing an anode into the internal cavity of a waveguide. Therefore, this deposition method then permits, on the one hand, to deposit an electrically conductive metal onto the inner surface of an internal cavity of a waveguide having a complex shape and, on the other hand, to reduce the size of the cross-section of the internal cavity of the waveguides, onto the inner surface of which it is possible to deposit such an electrically conductive metal.

This deposition method also advantageously permits to reduce the defects and the fragile phases in the layer of electrically conductive metal deposited on the inner surface of an internal cavity of a waveguide, in comparison with the layers of electrically conductive metal deposited by the methods of the state of the art.

Yet another advantage consists in that the deposition method permits to achieve a rate of recovery of the inner surface of an internal cavity of a waveguide of 100% and permits to obtain a smoothing effect on such an inner surface.

This deposition method also permits to obtain a metallurgical continuity between the waveguide and the layer of electrically conductive metal deposited on the inner surface of the internal cavity of this waveguide.

Finally, this deposition method can easily be industrialized and its number of steps is limited.

Further aims and advantages of the present invention will become clear during the following description relating to embodiments, which are given only by way of indicative and non-restrictive examples.

The understanding of this description will be facilitated when referring to the attached drawings.

DETAILED DESCRIPTION OF THE PREFERRED EMBODIMENTS

The present invention is related to the field of the manufacture of waveguides, more particularly metallized waveguides.

Figure 1:
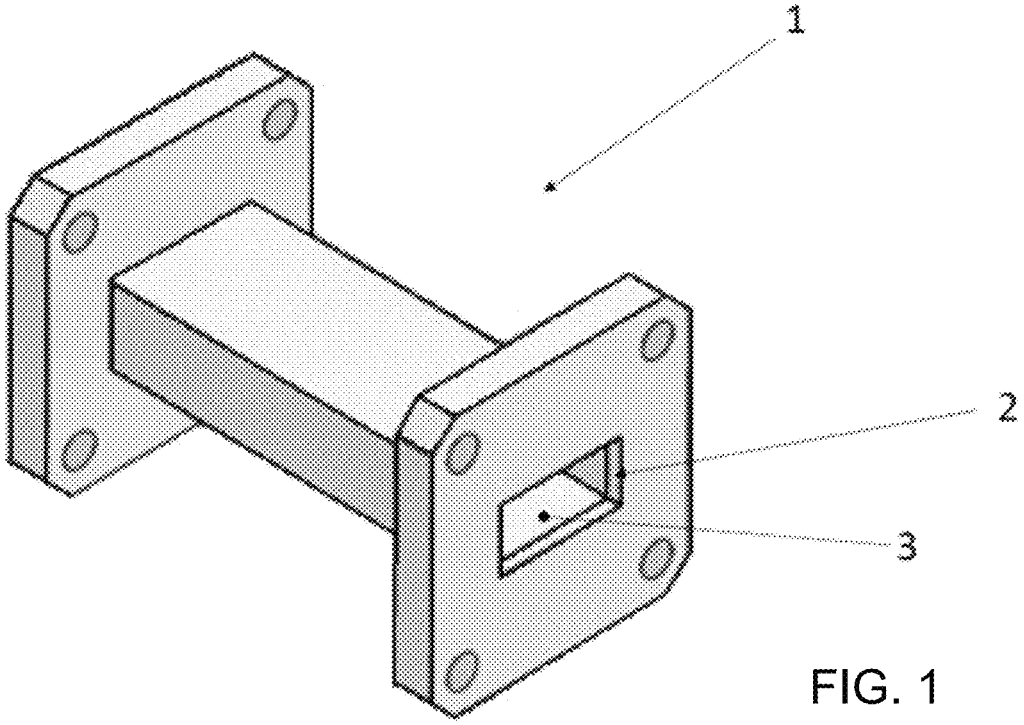
FIG. 1 represents a schematic side view of a waveguide.

Such a metallized waveguide G includes a waveguide 1 (shown in FIG. 1), which includes an internal cavity 2 having an inner surface 3. Such a metallized waveguide G also includes a layer C of an electrically conductive metal 4 deposited on at least one portion of this inner surface 3.

Figure 3:
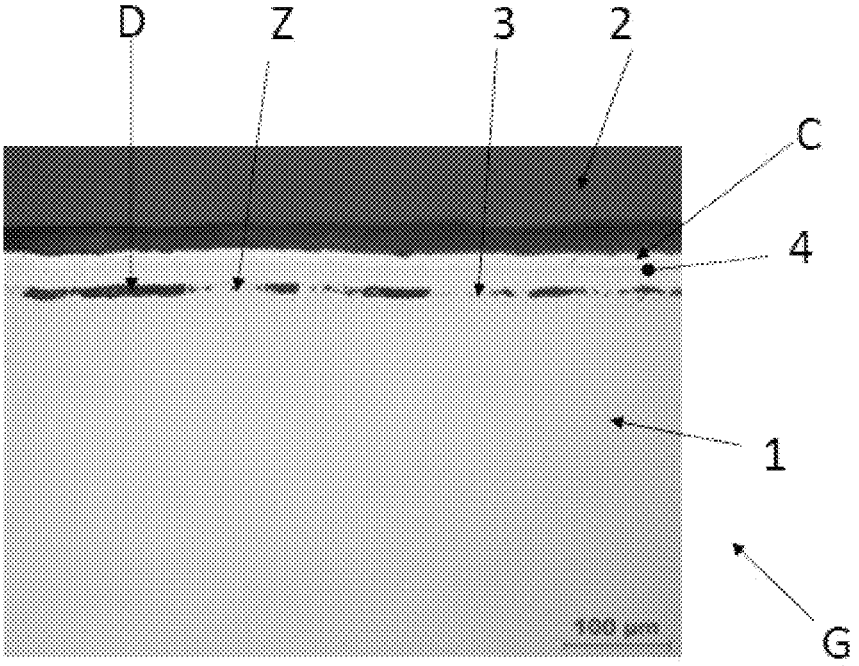
FIG. 3 represents a schematic, partial and cross-sectional view of a metallized waveguide, which includes, on the one hand, a waveguide including an internal cavity having an inner surface and, on the other hand, a layer of an electrically conductive metal deposited on this inner surface, this metallized waveguide being obtained by implementing a method in accordance with the state of the art.

In FIG. 3 is shown a schematic, partial and cross-sectional view of such a metallized waveguide G obtained by implementing a method for depositing an electrically conductive metal 4 onto the inner surface 3 of an internal cavity 2 of a waveguide 1, this deposition method being in accordance with the state of the art. As can be seen in this FIG. 3, this metallized waveguide G has metallurgical defects D or fragile areas Z, at the level of the inner surface 3 of the internal cavity 2 of the waveguide 1.

In order to cope with at least these drawbacks, there has been devised a new method for depositing an electrically conductive metal 4 onto at least one portion of the inner surface 3 of an internal cavity 2 of such a waveguide 1.

This method consists in that:

a suspension S is prepared, which contains at least one liquid and at least one precursor of the electrically conductive metal in suspension in said at least one liquid;

at least one portion of the inner surface 3 of the internal cavity 2 of the waveguide 1 (even the entire inner surface 3 of the internal cavity 2 of the waveguide 1, even also this entire waveguide 1) is coated with the suspension S;

at least said portion of the inner surface 3 of the internal cavity 2 of the waveguide 1 (even the entire inner surface 3 of the internal cavity 2 of the waveguide 1 coated with the suspension S, even the entirety of this waveguide 1 coated with the suspension S) is heat-treated.

As mentioned above, a step of this method consists in that a suspension S is prepared, which contains at least one liquid and at least one precursor of the electrically conductive metal 4 suspended in said at least one liquid.

In this respect, it should be observed that, in said suspension S, said at least one liquid represents between 6 and 12% by weight of the suspension S (preferably about 9.4% by weight of the suspension S), so that said at least one liquid and said at least one precursor represent 100% by weight of this suspension S.

In addition, said at least one liquid at least partially consists of at least one solvent (namely which at least partially consists of alcohol) and/or of at least one binder (namely which at least partially consists of water).

According to a first embodiment, said at least one liquid at least partially consists of at least one binder, which at least partially consists of water. According to a preferred embodiment of this first embodiment, said at least one liquid entirely consists of water.

According to a second embodiment, said at least one liquid at least partially consists of at least one solvent, which at least partially consists of alcohol. According to a preferred embodiment of this second embodiment, said at least one liquid entirely consists of alcohol.

According to a third embodiment, said at least one liquid at least partially consists, on the one hand, of at least one solvent, namely which at least partially consists of alcohol and, on the other hand, of at least one binder, namely which at least partially consists of water.

According to a preferred embodiment of this third embodiment, said at least one liquid at least partially (or even entirely) consists of a solvent consisting of alcohol and a binder consisting of water.

Additionally, said at least one liquid can also at least partially consist of at least one adjuvant.

According to a preferred embodiment of the invention, said at least one liquid at least partially (or even, and preferably, entirely) consists, on the one hand, of at least one solvent, which at least partially (or even, and preferably, entirely) consists of alcohol, and which represents between 2 and 5% by weight of the suspension S (preferably about 3.7% by weight of this suspension S), and, on the other hand, of at least one binder, which at least partially (or even, and preferably, entirely) consists of water, and which represents between 4 and 7% by weight of the suspension S (preferably about 5.7% by weight of this suspension S).

In said suspension S, the precursor of the electrically conductive metal 4 then represents between 88 and 94% by weight of the suspension S (preferably about 90.6% by weight of the suspension S), so that said at least one liquid (namely at least said at least one solvent and/or said at least one binder, even said at least one adjuvant) and the precursor represent 100% by weight of this suspension S.

In this respect, it should be observed that good results are obtained for a suspension S, which contains:

- a liquid entirely consisting, on the one hand, of a solvent, which entirely consists of alcohol, and which represents about 3.7% by weight of the suspension S, and, on the other hand, of a binder, which entirely consists of water, and which represents about 5.7% by weight of the suspension S;
- a precursor of the electrically conductive metal 4, which represents about 90.6% by weight of the suspension S.

As regards the precursor of the electrically conductive metal 4, it at least partially (even, and preferably, entirely) consists of at least one powder, which is fusible, and which at least partially (even, and preferably, entirely) consists of at least one alloy of the electrically conductive metal 4 and another metal.

According to a preferred embodiment of the invention, said electrically conductive metal 4 at least partially (even, and preferably, entirely) consists of silver.

In addition, said at least one alloy mentioned above then consists of an alloy of silver and copper.

As mentioned above, a step of the method according to the invention consists in that a suspension S is prepared, which contains at least one liquid and at least one precursor of the electrically conductive metal 4 suspended in said at least liquid.

In this respect, it should be observed that, when such a suspension S is prepared, the precursor of the electrically conductive metal 4 is introduced into a container, before introducing, into this container and progressively, said at least one liquid. The suspension S is homogenized, namely by stirring, more particularly using a magnetic stirrer. This suspension S is kept under stirring at least until the coating of said at least one inner surface 3 of the internal cavity 2 of the waveguide 1 with the suspension S.

As mentioned above, a step of the method consists in that said at least one portion of the inner surface 3 of the internal cavity 2 of the waveguide 1 is coated with the suspension S.

In this respect, it should be observed that, when coating said at least one portion of such an inner surface 3, at least said at least one portion of the inner surface 3 of the internal cavity 2 of the waveguide 1 is immersed into the suspension S or a film of the suspension S is deposited (more particularly using a brush or the like) at least onto said at least one portion of the inner surface 3.

Figure 2:
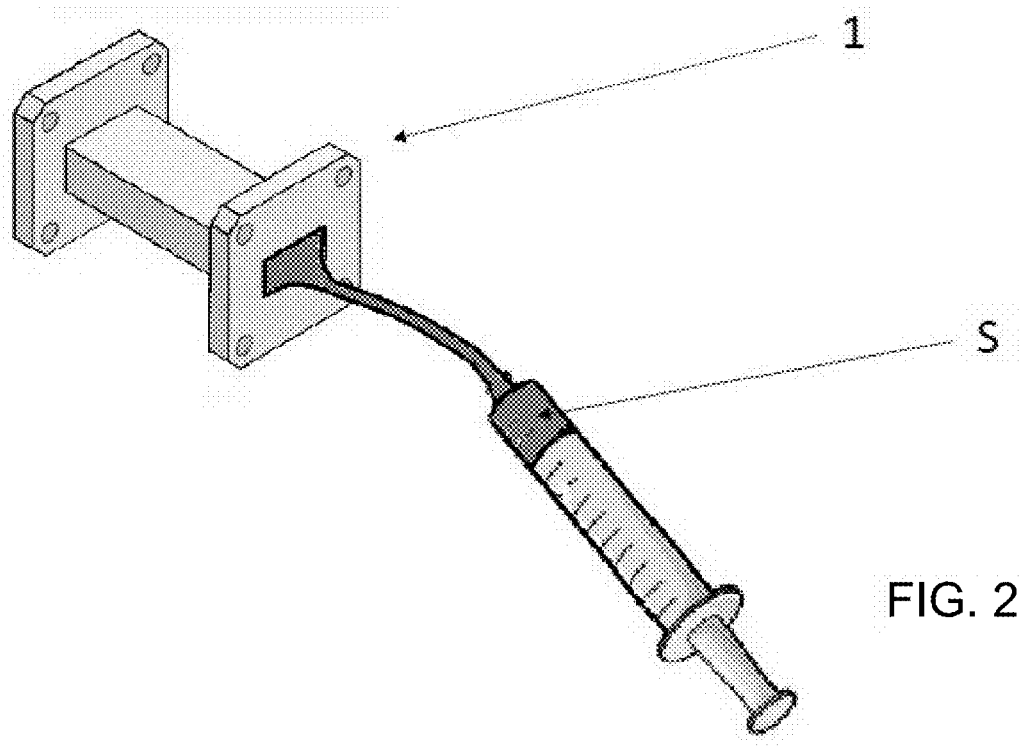
FIG. 2 represents a step of the method for depositing an electrically conductive metal onto at least one portion of the inner surface of an internal cavity of the waveguide shown in FIG. 1, this step consisting in coating said at least one portion of the inner surface of the internal cavity of such a waveguide with a suspension, which contains at least one liquid and at least one precursor of the electrically conductive metal in suspension in said at least one liquid.

However, alternatively and according to a preferred embodiment of the invention, when coating said at least one portion of such an inner surface 3, said suspension S is injected into the internal cavity 2 of waveguide 1, as can be seen in FIG. 2 and/or using a pump, a syringe or the like.

In this respect, it should be observed that another step of the method consists, after having coated said at least one portion of the inner surface 3 of the internal cavity 2 of the waveguide 1 with said suspension S (namely by injection of said suspension S into the internal cavity 2 of the waveguide 1), in that the suspension S is removed from this internal cavity 2, more particularly under the force of gravity.

Yet another feature of the invention consists in that, after having coated said at least one portion of the inner surface 3 of the internal cavity 2 of the waveguide 1 with said suspension S, the thickness of the precursor of electrically conductive metal 4 on this inner surface 3 is between 60 and 100 microns, preferably of about 80 microns.

As mentioned above, a step of the method consists in that at least one portion of the inner surface 3 of the internal cavity 2 of the waveguide 1 is coated with the suspension S.

In this respect, it should be observed that, according to a first embodiment, the entire inner surface 3 of the internal cavity 2 of the waveguide 1 is coated with the suspension S.

However, according to another embodiment, only a portion of the inner surface 3 of the internal cavity 2 of the waveguide 1 is coated with the suspension S. To this end, prior to the coating step, the portion or portions of the inner surface 3 of the internal cavity 2 of the waveguide 1, which are not to be coated, are treated, using an anti-wetting agent or the like.

Another feature of the method according to the invention consists in that, before coating at least one portion of the inner surface 3 of the internal cavity 2 of the waveguide 1 with the suspension S, at least said at least one portion of the inner surface 3 of the internal cavity 2 of the waveguide 1, even the entirety of this inner surface 2, even the entirety of the waveguide 1 is degreased.

In this respect, it should be observed that such a degreasing is carried out using a solvent, namely acetone.

Additionally, such a degreasing is carried out by immersion of the waveguide 1 into at least one bath (preferably into several successive baths) containing such a solvent. Such a degreasing can be improved when it is carried out under ultrasounds, namely in an ultrasonic tank containing a bath as mentioned above.

As mentioned above, the method consists in that at least said portion of the inner surface 3 of the internal cavity 2 of the waveguide 1 coated with the suspension S is heat-treated.

In this respect, it should be observed that, when at least said portion of the inner surface 3 of the internal cavity 2 of the waveguide 1 coated with the suspension S (even the entirety of this inner surface 2 coated with this suspension S, also even the entirety of the waveguide 1 coated with this suspension S) is heat-treated, at least this portion of the inner surface 3 (even the whole of this inner surface 2 coated with this suspension S, even the entirety of the waveguide 1 coated with this suspension S) is heat-treated under an inert atmosphere or under a reducing atmosphere.

More particularly, when heat-treating at least this portion of the inner surface 3 (even the entirety of this inner surface 2 coated with this suspension S, even the entirety of the waveguide 1 coated with this suspension S) under an inert atmosphere, at least this portion of the inner surface 3 (even the entirety of this inner surface 2 coated with this suspension S, even the entirety of the waveguide 1 coated with this suspension S) is treated under an inert gas, namely argon.

Alternatively, when heat-treating at least this portion of the inner surface 3 (even the entirety of this inner surface 2 coated with this suspension S, even the entirety of the waveguide 1 coated with this suspension S) under a reducing atmosphere, at least this portion of the inner surface 3 (even the entirety of this inner surface 2 coated with this suspension S, even the entirety of the waveguide 1 coated with this suspension S) is treated under a reducing gas, namely hydrogen.

Alternatively or (and preferably) additionally, when heat-treating at least said portion of the inner surface 3 of the internal cavity 2 of the waveguide 1 coated with the suspension S (even the entirety of this inner surface 2 coated with this suspension S, even the entirety of the waveguide 1 coated with this suspension S), at least this portion of the inner surface 3 (even the entirety of this inner surface 2 coated with this suspension S, even the entirety of the waveguide 1 coated with this suspension S) is heat-treated under vacuum, namely under secondary vacuum.

In addition, when heat-treating at least said portion of the inner surface 3 of the internal cavity 2 of the waveguide 1 coated with the suspension S (even the entirety of this inner surface 2 coated with this suspension S, even the entirety of the waveguide 1 coated with this suspension S), at least this portion of the inner surface 3 (even the entirety of this inner surface 2 coated with this suspension S, even the entirety of the waveguide 1 coated with this suspension S) and/or this suspension S are heated at a temperature higher than or equal to the melting temperature of said at least one precursor of the electrically conductive metal 4.

In this respect, it should be observed that this heating is preferably ensured under an inert atmosphere or under a reducing atmosphere or (and preferably) under vacuum, more particularly under secondary vacuum.

A particular embodiment then consists in ensuring this heating by observing a plateau (namely a plateau lasting about one hour) at this temperature (namely at a temperature higher than or equal to the melting temperature of said at least one precursor of the electrically conductive metal 4) and/or in ensuring this heating at a temperature of about 820° C. and/or under vacuum (more particularly under secondary vacuum).

A preferred embodiment consists in ensuring this heating by observing a plateau (namely a plateau lasting about one hour) at this temperature (namely at a temperature higher than or equal to the melting temperature of said at least one precursor of the electrically conductive metal 4), at a temperature of about 820° C., and under vacuum (more particularly under secondary vacuum).

Such a heating advantageously permits the precursor of the electrically conductive metal 4 to melt and to interact with the material of the waveguide 1, more particularly through a phenomenon of dissolution and/or diffusion.

As mentioned above, said at least one liquid at least partially consists of at least one binder.

In this respect, it should be observed that, when heat-treating at least said portion of the inner surface 3 of the internal cavity 2 of the waveguide 1 coated with the suspension S (even the entirety of this inner surface 2 coated with this suspension S, even the entirety of the waveguide 1 coated with this suspension S), at least this portion of the inner surface 3 (even the entirety of this inner surface 2 coated with this suspension S, even the entirety of the waveguide 1 coated with this suspension S) and/or this suspension S are heated at a temperature higher than or equal to the debinding temperature of the binder.

In this respect, it should be observed that this heating is preferably ensured under an inert atmosphere or under a reducing atmosphere or (and preferably) under vacuum, more particularly under secondary vacuum.

A particular embodiment then consists in ensuring this heating by observing a plateau (namely a plateau lasting about one hour) at this temperature (namely at a temperature higher than or equal to the debinding temperature of the binder) and/or in ensuring this heating at a temperature of about 500° C. and/or under vacuum (more particularly under secondary vacuum).

A preferred embodiment consists in ensuring this heating by observing a plateau (namely a plateau lasting about one hour) at this temperature (namely at a temperature higher than or equal to the debinding temperature of the binder), at a temperature of about 500° C., and under vacuum (more particularly under secondary vacuum).

In this respect, it should be observed that at least this portion of the inner surface 3 (even the entirety of this inner surface 2 coated with this suspension S, even the entirety of the waveguide 1 coated with this suspension S) and/or this suspension S are heated at a temperature higher than or equal to the debinding temperature of the binder, before at least this portion of the inner surface 3 (even the entirety of this inner surface 2 coated with this suspension S, even the entirety of the waveguide 1 coated with this suspension S) and/or this suspension S are heated at a temperature higher than or equal to the melting temperature of said at least one precursor of the electrically conductive metal 4.

In fact, the heating is ensured inside an oven.

Another step of the method consists in that, after the heating, the cooling down of at least the waveguide 1 is ensured, with the inertia of the oven.

Another feature of the invention consists in that the waveguide 1 is at least partially made of a titanium alloy.

The invention also relates to a method for manufacturing a metallized waveguide G including (as mentioned above), on the one hand, a waveguide 1, which includes an internal cavity 2 having an inner surface 3 and, on the other hand, a layer C of an electrically conductive metal 4 deposited on at least one portion of this inner surface 3 (even on the entirety of this inner surface 2, even on the entirety of the waveguide 1).

This manufacturing method is characterized in that the layer C of the electrically conductive metal 4 is deposited onto said at least one portion of the inner surface 3 of the internal cavity 2 of the waveguide 1 (even onto the entirety of this inner surface 2, even onto the entirety of the waveguide 1), by implementing the deposition method described above.

Finally, the invention relates to a metallized waveguide G, which includes (as described above), on the one hand, a waveguide 1, which includes an internal cavity 2 having an inner surface 3 and, on the other hand, a layer C of an electrically conductive metal 4 deposited on at least one portion of this inner surface 3 (even on the entirety of this inner surface 2, even on the entirety of the waveguide 1). This metallized waveguide G is obtained by implementing the manufacturing method described above.

Figure 4:
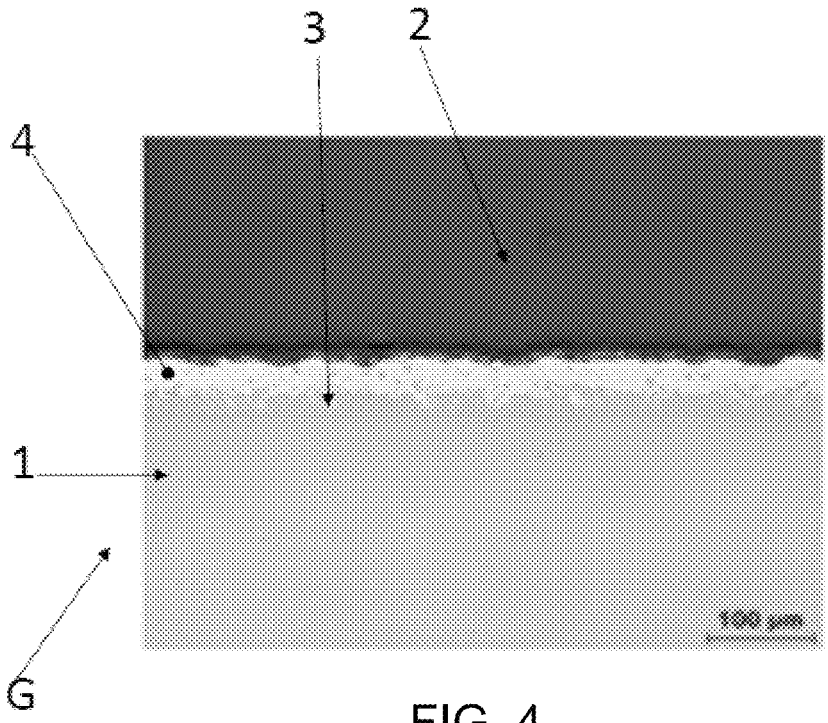
FIG. 4 represents a schematic, partial and cross-sectional view of a metallized waveguide, which includes, on the one hand, a waveguide including an internal cavity having an inner surface and, on the other hand, a layer of an electrically conductive metal deposited on this inner surface, by implementing the method according to the invention.

As can be seen in FIG. 4, this metallized waveguide G (obtained by implementing the method according to the invention) is free of metallurgical defects or of fragile areas, at the level of the inner surface 3 of the internal cavity 2 of waveguide 1.

What is claimed:

1. A method for depositing an electrically conductive metal onto at least one portion of the inner surface of an internal cavity of a waveguide, the method comprising:

preparing a suspension containing at least one liquid and at least one precursor of the electrically conductive metal suspended in the at least one liquid;

coating at least one portion of the inner surface of the internal cavity of the waveguide with the suspension; and heat-treating at least the portion of the inner surface of the internal cavity of the waveguide with the suspension, thereby producing a metallized waveguide having the electrically conductive metal deposited on at least one portion of the inner surface, wherein the at least one precursor of the electrically conductive metal comprises at least one powder, which is fusible, and which comprises at least one alloy of the electrically conductive metal and another metal.

2. The method according to claim 1, wherein the at least one liquid comprises at least one selected from the group consisting of at least one solvent and at least one binder.

3. The method according to claim 2, wherein the at least one liquid comprises at least one solvent and at least one binder.

4. The method according to claim 3, wherein the at least one solvent represents from 2 to 5% by weight of the suspension and the at least one binder represents from 4 to 7% by weight of the suspension.

5. The method according to claim 4, wherein the at least one solvent comprises alcohol and the at least one binder comprises water.

6. The method according to claim 3, wherein, in the heat-treating of the at least one portion of the inner surface of the internal cavity of the waveguide coated with the suspension, the at least one portion of the inner surface, the suspension, or both the at least one portion of the inner surface and the suspension are heated at a temperature higher than or equal to a debinding temperature of the binder.

7. The method according to claim 3, wherein the solvent is alcohol and the binder is water.

8. The method according to claim 2, wherein the at least one liquid comprises at least one solvent, and the solvent is alcohol.

9. The method according to claim 2, wherein the at least one liquid comprises at least one binder, and the binder is water.

10. The method according to claim 1, wherein the electrically conductive metal comprises silver.

11. The method according to claim 1, wherein the electrically conductive metal comprises silver, and the at least one alloy consists of an alloy of silver and copper.

12. The method according to claim 1, wherein, in the coating of the at least one portion of the inner surface of the internal cavity of the waveguide with the suspension, at least one of the following is performed:

the suspension is injected into the internal cavity of the waveguide, at least the at least one portion of the inner surface of the internal cavity of the waveguide is immersed in the suspension, a film of the suspension is deposited at least on the at least one portion of the inner surface.

13. The method according to claim 1, wherein, in the heat-treating of the at least one portion of the inner surface of the internal cavity of the waveguide coated with the suspension, the at least one portion of the inner surface is heat-treated under an inert atmosphere or under a reducing atmosphere.

14. The method according to claim 1, wherein, in the heat-treating of the at least one portion of the inner surface of the internal cavity of the waveguide coated with the suspension, the at least one portion of the inner surface is heat-treated under secondary vacuum.

15. The method according to claim 1, wherein, in the heat-treating of the at least one portion of the inner surface of the internal cavity of the waveguide coated with the suspension, the at least one portion of the inner surface, the suspension, or both the at least one portion of the inner surface and the suspension are heated at a temperature higher than or equal to a melting temperature of the at least one precursor of the electrically conductive metal.

16. The method according to claim 1, wherein the waveguide comprises a titanium alloy.

17. The method according to claim 1, wherein the metallized waveguide produced comprises a layer of the electrically conductive metal deposited on the at least one portion of the inner surface.

18. A method for depositing an electrically conductive metal onto at least one portion of the inner surface of an internal cavity of a waveguide, the method comprising:

preparing a suspension containing at least one liquid and at least one precursor of the electrically conductive metal suspended in the at least one liquid;

coating at least one portion of the inner surface of the internal cavity of the waveguide with the suspension; and heat-treating at least the portion of the inner surface of the internal cavity of the waveguide with the suspension, thereby producing a metallized waveguide having the electrically conductive metal deposited on at least one portion of the inner surface, wherein, in the heat-treating of the at least one portion of the inner surface of the internal cavity of the waveguide coated with the suspension, the at least one portion of the inner surface, the suspension, or both the at least one portion of the inner surface and the suspension are heated at a temperature higher than or equal to a melting temperature of the at least one precursor of the electrically conductive metal.

19. The method according to claim 18, wherein the waveguide comprises a titanium alloy.

20. A method for depositing an electrically conductive metal onto at least one portion of the inner surface of an internal cavity of a waveguide, the method comprising:

preparing a suspension containing at least one liquid and at least one precursor of the electrically conductive metal suspended in the at least one liquid;

coating at least one portion of the inner surface of the internal cavity of the waveguide with the suspension; and heat-treating at least the portion of the inner surface of the internal cavity of the waveguide with the suspension, thereby producing a metallized waveguide having the electrically conductive metal deposited on at least one portion of the inner surface, wherein the waveguide comprises a titanium alloy.

* * * * *